US005240254A

United States Patent [19]

Adlam

[11] Patent Number: 5,240,254

[45] Date of Patent: Aug. 31, 1993

[54] GOLF TEE AND ATTACHMENT THEREFOR

[76] Inventor: Robert P. Adlam, 21 Wentworth Avenue, Slough, Berkshire, SL2 2DP, England

[21] Appl. No.: 926,351

[22] Filed: Aug. 6, 1992

[30] Foreign Application Priority Data

Aug. 7, 1991 [GB] United Kingdom ..... 9116977

[51] Int. Cl.[5] ..... A63B 69/36

[52] U.S. Cl. ..... 273/187.1; 273/187.3

[58] Field of Search ..... 273/187.1, 33, 202-212, 273/195 R, 196, 187 A, 187.3

[56] References Cited

U.S. PATENT DOCUMENTS

| | | | |
|---|---|---|---|
| 1,596,110 | 8/1926 | Lynch | 273/33 X |
| 2,119,044 | 5/1938 | Davids | 273/33 X |
| 3,347,551 | 10/1967 | Dreyfus | 273/33 X |
| 3,883,144 | 5/1975 | Lazow | 273/183 A |
| 4,128,245 | 12/1978 | Vlach | 273/187.1 |
| 4,151,990 | 5/1979 | Josenhans | 273/187.1 |
| 4,181,300 | 1/1980 | Bradley | 273/33 |
| 4,765,625 | 8/1988 | Miner | 273/187.1 |
| 5,133,556 | 7/1992 | Karasavas | 273/187.3 |

FOREIGN PATENT DOCUMENTS

| | | | |
|---|---|---|---|
| 7001047 | 2/1987 | PCT Int'l Appl. | 273/187.1 |

*Primary Examiner*—George J. Marlo
*Attorney, Agent, or Firm*—Kinney & Lange

[57] ABSTRACT

A device for attachment to a golf tee comprises a first marker to be aligned with the intended direction of travel of a golf ball and a second marker which lies generally normal to the first marker and which is intended to be aligned with the face of a golf club with which a golf ball supported by the tee is to be struck. The device includes an aperture through which the shank of a golf tee can pass to enable the device to be selectively attached to the golf tee. The device also includes a platform formed with a plurality of angularly spaced radially extending line indicators separate from the boundary of the aperture which enables the first marker to be offset from a true line to counteract inter alia a natural slice.

6 Claims, 2 Drawing Sheets

GOLF TEE AND ATTACHMENT THEREFOR

BACKGROUND OF THE INVENTION

This invention relates to golf tee attachments which assist a golfer when addressing a tee mounted golf ball.

A conventional golf tee generally comprises a shank having a cup at its upper end on which a golf ball can be supported. When preparing for a drive, a golfer seeks to position himself so that the open face of the head of his golf club strikes the ball squarely with the club head moving in the intended direction of travel of the ball. It is often the case that a golfer finds greater difficulty in achieving striking the ball correctly.

The present invention sets out to provide a detachable fitment for a golf tee which assists a golfer in adopting a correct stance when addressing a golf ball.

DESCRIPTION OF THE PRIOR ART

A golf tee comprising a horizontal "T" shaped support with downwardly extending legs at each support extremity is disclosed in U.S. Pat. No. 4,181,300 to Arthur S. Bradley. Whereas the golf tee disclosed includes a tapered support which provides a general line of straight guidance to assist in lining up a golfers tee shot, the Bradley tee is essentially intended to provide an alternative ball support which removes the need for a conventional tee shank for insertion into the ground. Also, the Bradley tee neither teaches the important features of a marker against which a golfer can align the head of his club nor graded markings to offset, for example, a golfer's natural slice. Further, Bradley does not teach a device for attachment to a golf tee.

U.S. Pat. No. 3,883,144 to Malcolm Lazou discloses a similar golf tee to that of Bradley except that in this disclosure the tee itself is conventional and carries on its shank an integral member which discloses a forwardly projecting arm to assist a golfer properly to align a tee shot.

SUMMARY OF THE INVENTION

According to the present invention in one aspect there is provided a device for attachment to a golf tee having a cup and a shank, the device comprising a first marker to be aligned with the intended direction of travel of a golf ball and a second marker which lies generally normal to be first marker and which is intended to be aligned with the face of a golf club with which a golf ball supported by the tee is to be struck, and means for selectively attaching the device onto and detaching the device from the shank or cup of a golf tee.

The first marker may comprise a pointer which projects forwardly of the cup of the tee and of a golf ball positioned on the cup. The second marker may comprise at least one arm which lies generally normal to the first pointer and which projects to a position beyond one side of the cup of the tee and of a golf ball positioned on the cup.

The second marker may comprise a pair of arms which project one to each side of the cup of the tee. One projecting arm of the second marker may be longer than the other projecting arm.

One or each arm may include a straight line indicator (for example a raised or printed straight line) to provide directional alignment of a golf club when addressing a golf ball supported on a cup of a tee. The first marker may also include a line indicator (for example a raised or printed straight line) which lies generally normal to the straight line indicator of the second marker.

The device preferably includes a central platform from which the markers radiate which includes a series of radial spaced line indicators to enable the first marker to be offset from a true line to counteract inter alia a natural slice.

The device is preferably formed with a bordered aperture through which the shank of a golf tee can pass for attachment purposes. Alternatively, the device includes a recess into which the cup or shank of a tee may extend for attachment purposes.

The device may include a skirt which defines a clasp for attaching the device to the shank of a golf tee. The skirt may be generally annular in cross-section, and may be divided into discrete skirt sections to assist location of the device onto the shank of a golf tee. Alternatively, the device may include a clasp in the form of two or more downwardly extending members which, in use, grip the shank or cup of a golf tee. In each of these arrangements, the device may be formed with a lip about the border of the aperture or recess which, in use, seats about the rim of a cup of a tee.

BRIEF DESCRIPTION OF THE DRAWINGS

The invention will now be described by way of example only with references to the accompanying diagrammatic drawings in which.

DETAILS AND DESCRIPTION OF A PREFERRED EMBODIMENT

Figure 1:
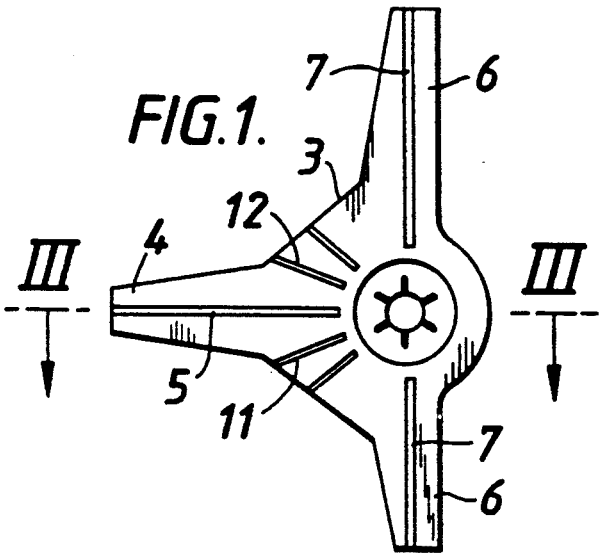
FIGS. 1 and 2 are respectively plan and side views of a golf tee fitted with a device in accordance with the invention.
Figure 2:
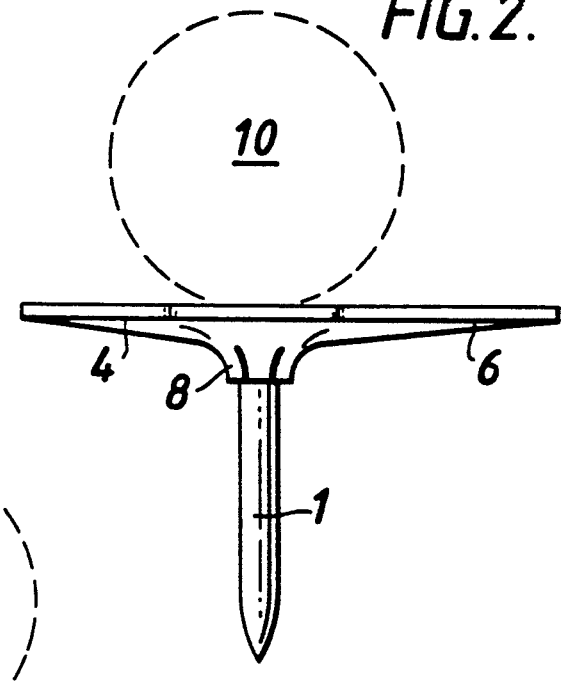
Figure 3:
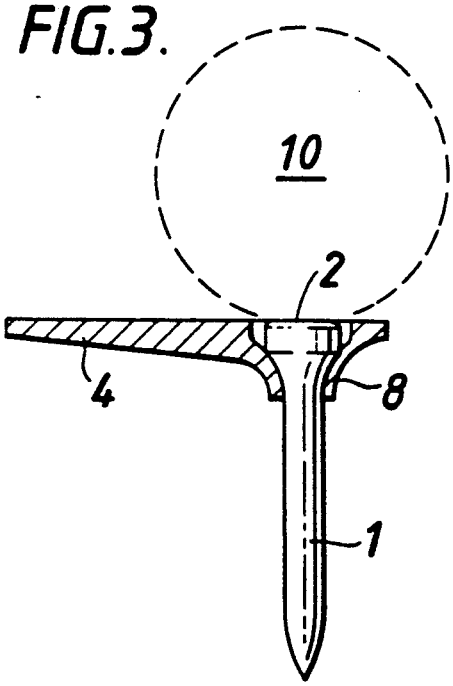
FIG. 3 is a section taken along lines III—III of FIG. 1.

The golf tee illustrated in FIGS. 1 to 3 comprises a shank 1 supporting a cup 2 and the tee attachment device comprises an apertured clip 3 carrying a forwardly facing pointer 4 including a straight line indicator 5 in the form of a raised of pointed line and two sidewards extending arms 6 each including a straight line indicator 7 in the form of a raised or printed straight line to provide directional alignment of a golf club when addressing a golf ball 10 (shown in broken line) supported on the cup 2 of the tee. The pointer 4 and arms 6 radiate outwardly from the cup 2, each projecting to a distance beyond the perimeter of the golf ball 10 when located on the cup 2. The straight line indicator 5 of the pointer is set at 90° to the arms 6, one of which extends to a greater distance than the other. The difference in length is to ensure that each arm can be seen by a golfer when addressing the ball. For left handed golfers, the respective lengths of the arms as illustrated would be reversed. Alternatively, both arms could be equal length. The attachment device is secured in place on the shank 1 of a tee by a simple split skirt clasp 8 formed in the underface of the attachment device.

As will be seen from FIG. 1 the apertured clip 3 includes a protector like extension 11 including raised or printed radial markings 12 (each set, for example, at an angle of 10° to its neighbours) which enable a golfer to set the pointer at an angle to accommodate a natural hook, sliced swing or cross winds.

The attachment device may be formed by any suitable process, these including injection moulding or extrusion.

The attachment device may be produced from any suitable material, for example plastics, nylon, polyvinyl, chloride, wood, wood composite or card, and may be supplied in any required colour. Additionally or alternatively, the attachment device may be coated with a fluorescent material for night use.

Figure 4:
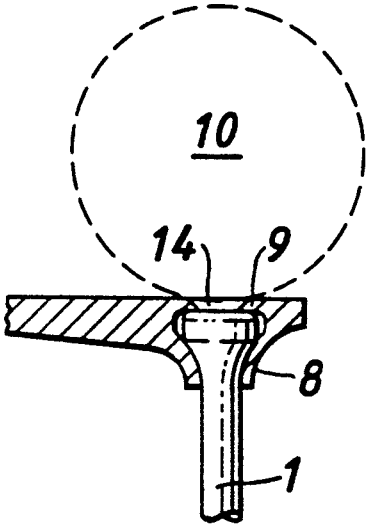
FIG. 4 is a similar section of an alternative tee and device in accordance with the invention.

As will be seen from FIGS. 3 and 4, the clip 3 may seat level with the upper rim of the cup 2 of the tee as shown in FIG. 3, or a lip 9 formed about the aperture (referenced 14) of the device may clip over the cup rim to prevent it slipping down the tee shank. This latter construction is illustrated in FIG. 4.

Figure 5:
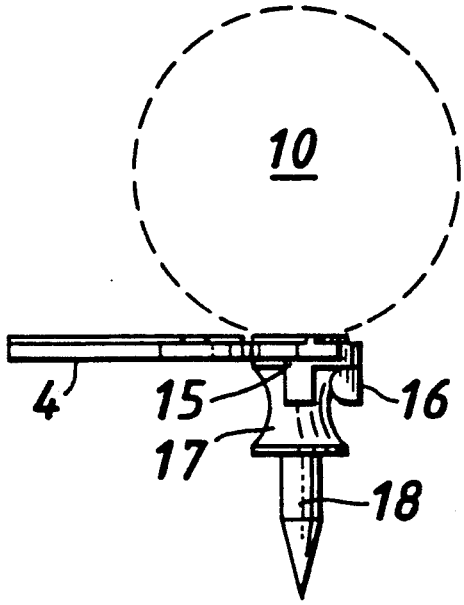
FIGS. 5 and 6 are respectively a side view and a plan view from above of an alternative device in accordance with the invention.
Figure 6:
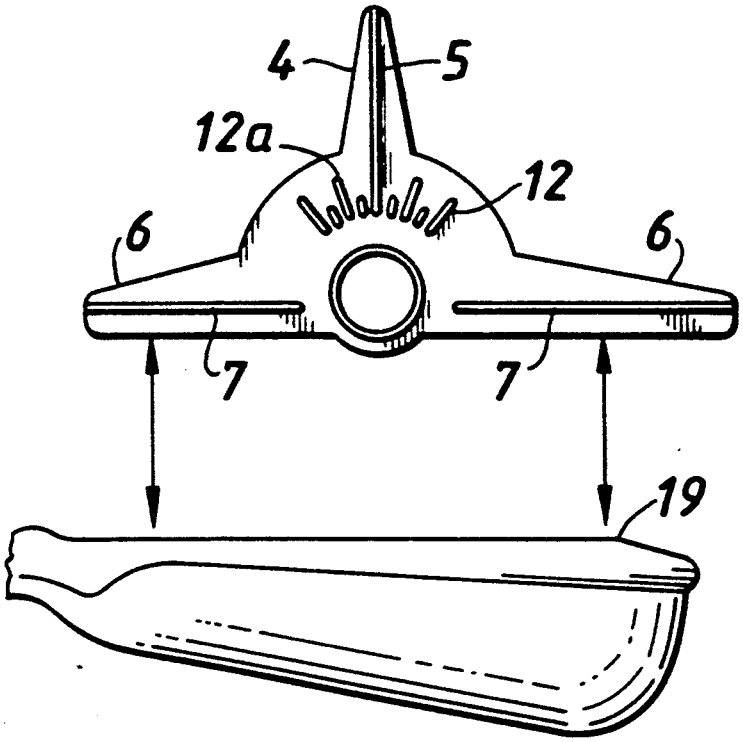

The device illustrated in FIG. 5 and 6 is similar in many respects to those illustrated in FIGS. 1 to 4 excepting that its clasp 15 differs from that shown in FIGS. 1 to 4 in that it comprises a plurality of individual spaced gripper members 16 which, in use, bear against the external curved surface of the upper section 17 of an alternative golf tee 18.. As will be seen from FIG. 6, in use the head 19 of a golf club is aligned carefully with the raised line 7 of the arms 6 when addressing the ball 10.

In use, the attachment device is located on the shank 1 and the tee is positioned in the ground with the straight line indicator 5 of the pointer 4 pointing in the required direction of travel of the golf ball. The golfer then positions himself such that the flat open face of the golf club lies substantially parallel to the indicator 7 of the arms 6. With the club so aligned the ball should, when struck following a good swing, travel in the direction of the pointer 4.

The pointer 4 may be offset from a true line to counteract a natural hooked or sliced swing or cross winds using the radial markings 12. these markings may subtend an angle of say, 10° to one another. Consequently to counteract a natural slice of say 20°, a golfer simply points the radial line 12*a* in the intended direction of his drive, carefully aligning the face of the head of his golf club with the lines 7 of the arms 6.

It will be appreciated that the foregoing is merely exemplary of golf tees in accordance with the invention and that modifications can readily be made thereto without departing from the true scope of the invention. Thus, the pointer and arms may take the form of lines present on a disc radiating outwardly from the tee or may be triangular in shape, the pieces of the triangle replacing or supplementing the arms and pointer.

I claim:

1. A tee including an elongated shank and a cup, and an attachment device, the device being formed as a single piece and including an aperture through which the shank of said golf tee can pass for selectively attaching the device to said golf tee, a first marker extending radially outwardly from said aperture for alignment with the intended direction of travel of a golf ball positioned on the cup of the golf tee to which the device is attached, and a second marker which lies generally normal to the first marker and which is intended to be aligned with the face of a golf club with which a golf ball supported by the tee is to be struck, and a platform including a plurality of angularly spaced radially extending line indicators separate from the boundary of the aperture and positioned to enable the first marker to be offset from a true line to counteract inter alia a natural slice.

2. The combination as claimed in claim 1 wherein the first marker comprises a pointer which projects forwardly of the cup of the tee and of a golf ball positioned on the cup.

3. The combination as claimed in claim 1 wherein the second marker comprises at least one arm which lies generally normal to the first pointer and which projects to a position beyond one side of the cup of the tee and of a golf ball positioned on the cup.

4. The combination as claimed in claim 1 wherein the second marker comprises a pair of arms which project one to each side of the cup of the tee.

5. A device as claimed in claim 4 wherein one projecting arm of the second marker is longer than the other projecting arm.

6. The combination as claimed in claim 1 further including a skirt which defines a clasp for attaching the device to the shank of said golf tee.

* * * * *